United States Patent [19]

Moretti et al.

[11] 4,376,453

[45] Mar. 15, 1983

[54] HYDRAULIC DISTRIBUTOR

[75] Inventors: Luciano Moretti; Giulio Dotti, both of Turin, Italy

[73] Assignee: Centro Ricerche Fiat S.p.A., Turin, Italy

[21] Appl. No.: 201,995

[22] Filed: Oct. 29, 1980

[30] Foreign Application Priority Data

Oct. 30, 1979 [IT] Italy ..... 69116 A/79

[51] Int. Cl.[3] ..... F15B 13/043

[52] U.S. Cl. ..... 137/625.64; 91/420; 91/433; 137/625.66

[58] Field of Search ..... 91/420, 433; 137/625.6, 137/625.63, 625.64, 625.66

[56] References Cited

U.S. PATENT DOCUMENTS 3,807,447 4/1974 Masuda ..... 91/433 X 4,031,813 6/1977 Walters et al. ..... 137/625.64 X

*Primary Examiner*—Gerald A. Michalsky

*Attorney, Agent, or Firm*—Frost & Jacobs

[57] ABSTRACT

The distributor is designed to control the supply of a fluid under pressure into a chamber of a hydraulic actuator and the outlet of fluid from another chamber of said actuator, and comprises a first chamber and a second chamber, which are designed to be communicated with one of said chambers of the actuator, and a slide valve movable in the direction of its axis in a corresponding seat of the distributor; the distributor comprises means which respond to the pressure prevailing inside said first and second chambers of the distributor and means for choking the cross-section of the outlet for the fluid from said first and second chambers of the distributor, said pressure-responsive means being connected to said choking means so that, as a result of a movement of the movable member of said actuator at a velocity higher than a predetermined velocity, said choking means bring about a reduction in the velocity of said movable body.

7 Claims, 6 Drawing Figures

HYDRAULIC DISTRIBUTOR

BACKGROUND OF THE INVENTION

The present invention relates to a hydraulic distributor designed to actuate a hydraulic actuator, for example a cylinder, by controlling the supply and outlet of the hydraulic fluid acting on the active surfaces of the movable member of the actuator itself. In particular, the distributor of the invention is designed to control automatically the rate of movement of said movable member so as to prevent its rate of movement from attaining excessively high values in any operating condition of the actuator.

Known hydraulic distributors intended to actuate an actuator normally comprise a slide valve designed to be brought from the rest position into two different positions, in each of which it connects hydraulically the source of fluid under pressure with a chamber of the actuator so as to actuate the movable member and, simultaneously, communicates the other chamber of said actuator with the outlet.

With distributors of this type, under certain operating conditions when the external force applied to the movable member of the actuator corresponds to the motive force generated by the pressure of the fluid on the movable member, the displacement of the movable member may occur at an excessively high velocity which is totally independent of the flow rate of the motive fluid fed into the actuator. In order to eliminate this disadvantage the hydraulic circuit, of which the distributor and actuator form part, is usually provided with valves throttling the flow of fluid towards the outlet so as to exert on the movable member of the actuator a back pressure capable of limiting the speed of forward movement thereof. With such a structural solution there is no strict control of the velocity of the movable member, since this velocity is not always proportional to the flow rate of fluid supplied to the actuator; furthermore, this control can take place only when the velocity of the movable member is within a well-defined range.

SUMMARY OF THE INVENTION

The object of the present invention is to devise a distributor of the type described, which does not have the aforementioned disadvantages and which, in particular, carries out fully automatically strict control of the velocity of the movable member of the actuator under all operating conditions, thus substantially allowing said member to be moved at a velocity proportional to the flow rate of the motive fluid supplied to the actuator itself.

On the basis of the present invention there is devised a distributor for a hydraulic circuit, which is designed to control the supply of a fluid under pressure into a chamber of a hydraulic actuator and the outlet of the said fluid from another chamber of said actuator, comprising a first chamber and a second chamber designed to be communicated with one of said chambers of the actuator, and a slide valve movable in the direction of its axis in a corresponding seat of the distributor and designed to adopt a first position, in which it connects hydraulically said first chamber of the distributor to a source of fluid under pressure and, simultaneously, said second chamber of the distributor to the outlet, and to adopt a second position, in which it connects hydraulically said second chamber of the distributor to said source of fluid and, simultaneously, said first chamber of the distributor to the outlet, said slide valve normally being held by restoring means in a rest position in which it prevents any communication between either of said two distributor chambers and between said fluid source and said outlet, characterised in that it comprises means responsive to the pressure prevailing inside said first and second chambers of the distributor, and means for choking the outlet cross-section for the fluid from said first and second chambers of the distributor, said pressure-responsive means being connected to said choking means so that, as a result of a reduction in the fluid pressure in said first or second chamber of the distributor, caused as a result of a displacement of the movable member of said actuator at a velocity higher than a predetermined velocity, said choking means bring about a decrease in said outlet cross-section from said second or first chamber of the distributor respectively, so as to cause an increase in the pressure in one of said chambers of the actuator in order to reduce the velocity of said movable member.

BRIEF DESCRIPTION OF THE DRAWINGS

For a better understanding of the distributor of the present invention, one particular form of embodiment thereof will now be described with reference to the accompanying drawings, in which.

DETAILED DESCRIPTION OF THE INVENTION

Figure 4:
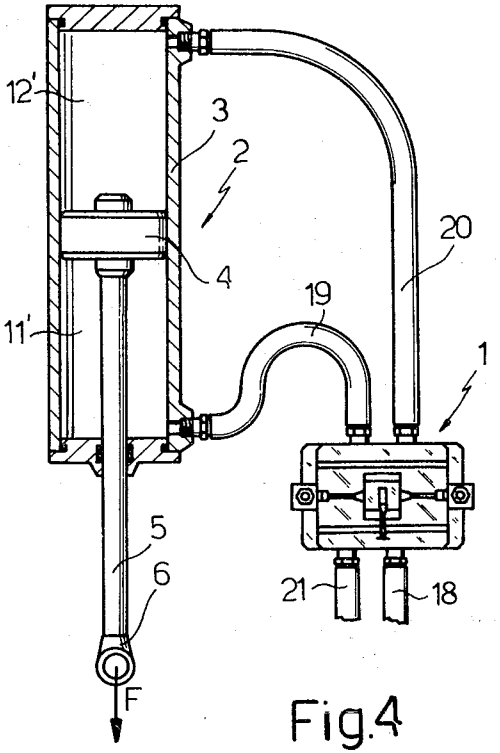
FIG. 4 illustrates a diagram of part of a hydraulic circuit in which is installed the distributor of the invention, designed to control the operation of a hydraulic actuator.

The distributor of the invention may be installed in a portion of a hydraulic circuit, such as that in FIG. 4 in which it is designated with the numeral 1, in order to control the operation of any hydraulic actuator, for example a hydraulic cylinder 2, provided with a casing 3 inside which can move a piston 4 attached to a rod 5, to the end 6 of which can be connected any other member intended to transmit thereto a force of any kind, e.g. a force (as denoted by F in FIG. 4) in a direction substantially coinciding with that of the aforesaid rod.

The distributor of the invention substantially comprises a body 9 (FIG. 1) provided with five substantially cylindrical chambers arranged side-by-side, the centre one of which is designated 10, two others designated 11 and 12 being arranged symmetrically with respect to the preceding ones, and the other two designated 13 and 14 also being arranged symmetrically with respect to the central chamber but at a greater distance therefrom; the aforementioned chambers are traversed longitudinally by a bore 15 of cylindrical section, a slide valve 16 being axially movable in the interior thereof.

The central chamber 10 is communicated through a duct 17 with a feed tube 18 (FIG. 4) designed to supply to the distributor itself fluid under pressure, the flow rate of which to the actuator 2 is controlled by the distributor itself. The chambers 11 and 12 are communicated respectively with the lower chamber 11' and upper chamber 12' of the above-mentioned cylinder through lengths of pipe 19 and 20, whereas the other two chambers 13 and 14 are communicated through other ducts (not shown) provided in the body 9 of the distributor with an outlet tube 21 (FIG. 4).

Figure 1:
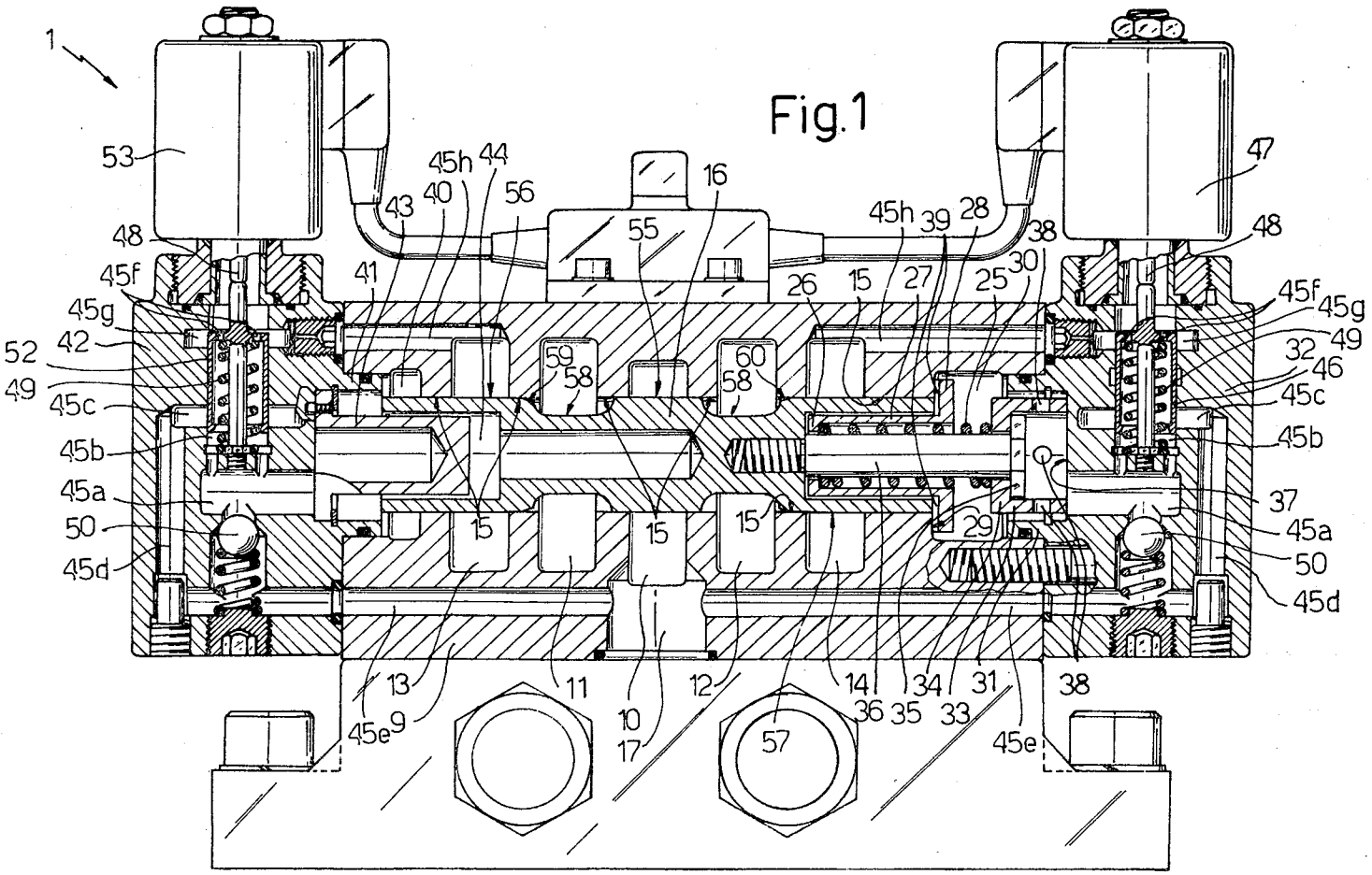
FIG. 1 illustrates a longitudinal section of the distributor in the rest position.

The slide valve 16 is kept in its rest position shown in FIG. 1, substantially at the centre of the body 9, by the action of a helical spring 25, one end of which bears on a shoulder 26 of a bush 27, designed to fit substantially into a corresponding bore provided in the right-hand end of the slide itself. A flange 28 of the aforesaid bush bears against a corresponding surface 29 of a cavity 30 which is provided in the right-hand part of the body 9 and which is closed by an annular projection 31 of a block 32 fixed to the body itself.

The other end of the spring 25 bears on a second bush 33, an annular inner shoulder 34 of which cooperates with the head 35 of a screw 36 screwed into a corresponding threaded bore of the slide valve 16, as clearly shown in FIG. 1. In the normal rest condition the second bush 33 bears on a surface 37 provided in the block 32; this bush is provided with a plurality of radial bores 38 and its external diameter is less than the internal diameter of the corresponding annular projection 31 in which it is fitted, so as to create between the bush and the projection a substantially annular duct.

As is clearly evident in FIG. 1, the outer diameter of the first bush 27 is smaller than that of the corresponding bore provided in the right-hand end of the slide valve 16, in which the bush itself is accommodated, so as to define between bore and bush an annular duct which communicates with the cavity 30 through substantially radial slots 39 provided in the flange part 28 of the bush itself.

In the other end of the body 9, to the left in FIG. 1, there is provided another cavity 40 which accommodates the corresponding end of the slide valve 16 and which is closed by an annular projection 41 of a block 42, this latter block also being fixed to the body 9; inside the bore of the aforesaid annular projection is arranged a cylindrical part 43 designed to be fitted with some radial play into a corresponding bore 44 provided in the left-hand end of the slide valve 16.

The cavity 30, which is provided in the right-hand end of the body 9, may be communicated with the central chamber 10 and duct 17 by means of a series of passages, i.e. bores 45*a* and 45*b*, the chamber 45*c* and bores 45*d* and 45*e*; alternatively, this cavity 30 may be communicated with the chamber 14 of the body 9 (and thus from said chamber with the outlet) by means of another series of passages, i.e. bores 45*a* and 45*b*, the chamber 45*c*, the bores 45*f* provided in a valve part 46 movable inside a corresponding bore of the block 32, the chamber 45*g* and the bore 45*h*.

The axial position of the aforementioned valve part is controlled by a corresponding electro-valve 47 carried by the block 32, a stem 48 of which acts directly on said valve part in opposition to the force of a corresponding helical spring 49 which tends to displace the part itself upwards in FIG. 1.

As clearly shown in FIG. 1, the bore 45*a* may be communicated directly with the bore 45*e* through a ball valve 50.

Similarly, the cavity 40 may be communicated either with the central chamber 10 and the duct 17 or with the chamber 13 of the body 9, by means of two series of passages completely analogous to those used to communicate the cavity 30 with the duct 17 and the chamber 14 respectively; since the arrangement of these two series of passages is almost entirely symmetrical with that of the analogous passages already described, they have been designated with the same reference numerals. A valve part 52, entirely corresponding to 46 and actuated by a corresponding electro-valve 53, is designed to communicate the chamber 40 alternately with the duct 17 or with the chamber 13.

The slide valve 16 essentially has three cylindrical control surfaces, a central one 55 and two lateral ones 56 and 57 separated from the former by cylindrical surfaces 58 of smaller diameter than that of the others; as clearly shown in FIG. 1, the surfaces 58 are joined to the control surfaces 55, 56 and 57 by a contour substantially forming a circumferential arc.

Figure 6:
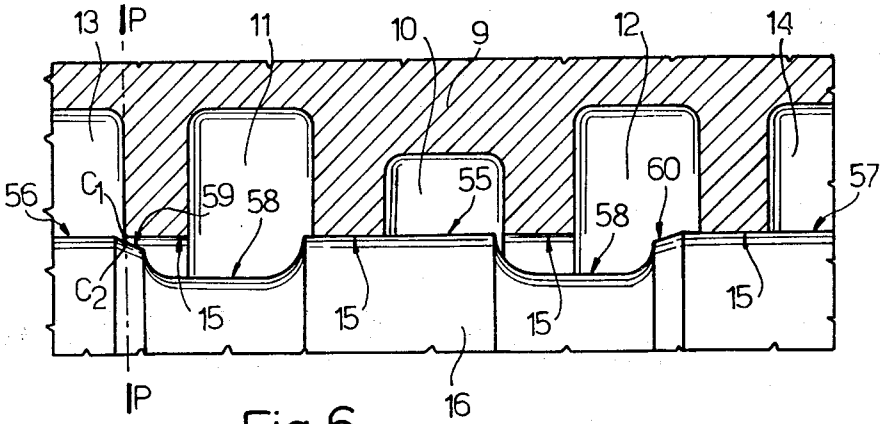
FIGS. 5 and 6 illustrate a detail of the distributor intended to show the structure of the slide valve in different positions.
Figure 5:
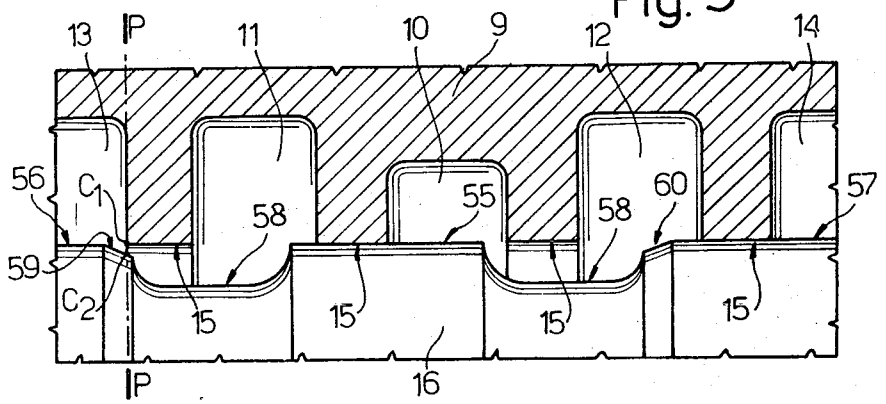

The axial length of the control surface 55 is at least such that it mates with the cylindrical surfaces of the corresponding portions of bore 15 which lie between the central chamber 10 and the chambers 11 and 12 arranged laterally thereto, so as to close the passage between the first chamber and these latter chambers. The axial length of each of the lateral control surfaces 56 and 57 is at least such that they mate with the portions of bore 15 lying between the chambers 11, 13 and 12, 14, so as to close the passage between the aforesaid chambers. The final portion, of predetermined length, of each of the control surfaces 56, 57 has a substantially conical surface 59 and 60 respectively (FIGS. 5 and 6).

The mode of operation of the distributor described above is as follows:

In the inoperative condition of the distributor shown in FIG. 1, the two electro-valves 47 and 53 are de-energised and the corresponding valve parts 46 and 52 are situated in the downward end-of-travel position, as shown in this same Figure, in which therefore each of them closes the passage between the bore 45*a* and chamber 45*b*, but leaving open the passage between the first bore mentioned above and the chamber 45*g*; under these circumstances each of the chambers 30 and 40 communicates with the outlet (and thus with the outlet pipe 21, FIG. 4) through the series of passages provided respectively between each of said chambers, the bore 45*a*, the bores 45*f* inside the valve part 46, the chamber 45*g* and the bore 45*h*. However, the fluid under pressure supplied through the feed pipe 18 (FIG. 4) to the duct 17 (FIG. 1) cannot reach the aforementioned chambers 30 and 40 because of the seal effected by the valve parts 46 and 52 which, by closing the connection between the chamber 45*c* and the bore 45*a*, prevent said fluid from entering the chambers themselves.

It is thus evident that the chambers 30 and 40 in communication with the outlet are substantially at atmospheric pressure and, therefore, that the outlet pressure (atmospheric) substantially acts on the end faces of the slide valve 16; this slide valve is thus able to adopt the position shown in FIG. 1 under the action of the force applied by the helical spring 25 which, by acting on the shoulder 34 of the second bush 33, keeps this latter substantially in contact with the surface 37 of the block 32; in this condition the flange 28 of the first bush 27 is substantially in contact with the associated support surface 29 and inside the associated bore provided in the right-hand end of the slide valve 16; the control surfaces 55, 56 and 57 of the slide valve, when arranged as shown FIG. 1, prevent any passage of the fluid entering the chamber 10 towards the adjacent chambers 11 and 12 and any passage between these latter chambers and the chamber adjacent thereto, respectively 13 and 14. In this way the supply of fluid to the hydraulic cylinder 2 is impeded (FIG. 4) and at the same time the release of the fluid itself towards the outlet is prevented.

Figure 2:
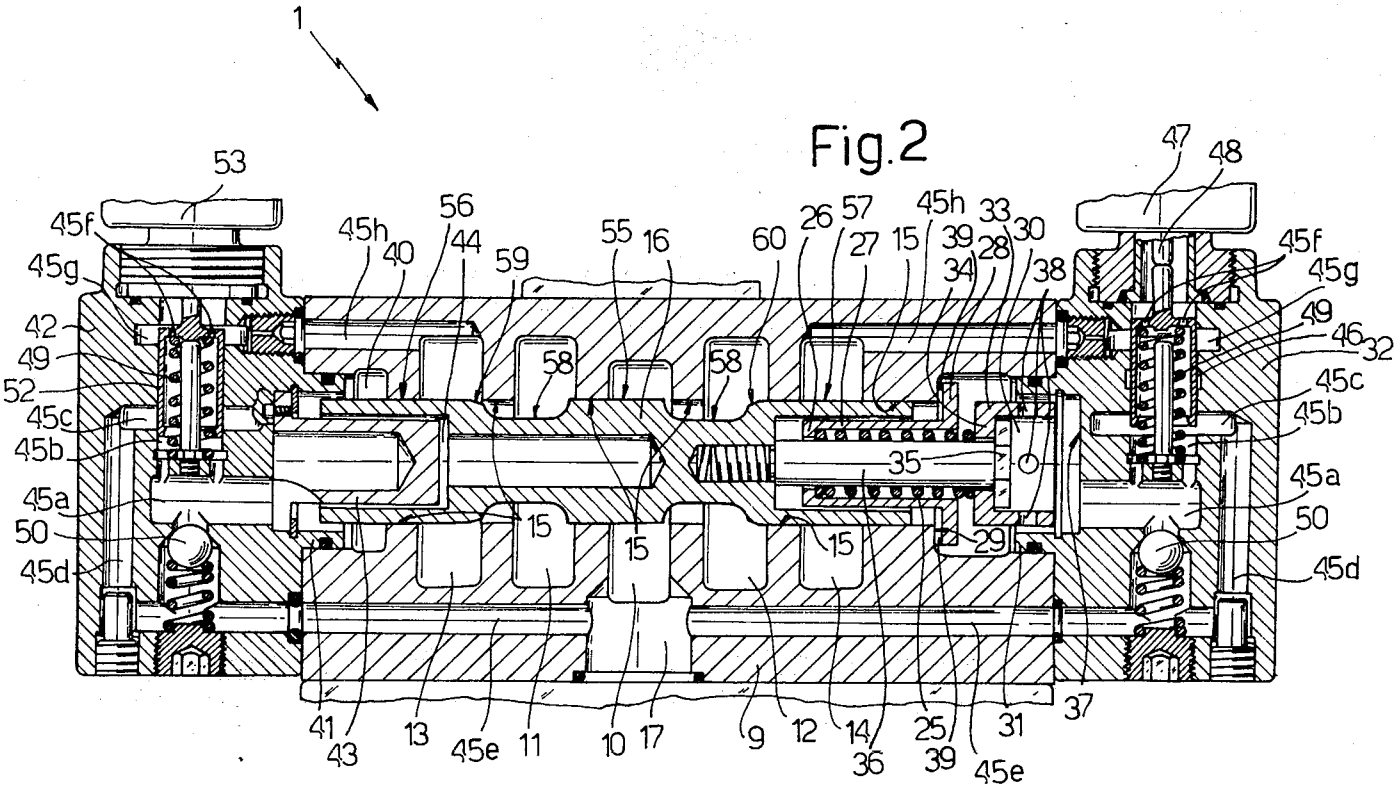
FIG. 2 illustrates a sectional view of the distributor, similar to that in the preceding Figure but in a first operative position.

If it is desired to actuate the displacement of the piston 4 in the aforementioned cylinder, for example downwards in FIG. 4, the electro-valve 47 is activated with the result that the corresponding valve part 46 is urged upwards in FIG. 1 so as to bring it into the position shown in FIG. 2, in which communication is effected between the bore 45*a* and the chamber 45*b*, whereas the passage between the bore 45*a* and the chamber 45*g* is closed. In these circumstances, the fluid under pressure passing through the duct 17, the bores 45*e*, 45*d*, the chamber 45*b* and the bore 45*a* may enter the inner cavity of the bush 33 and through the bores 38 of this latter as far as the interior of the chamber 30; from this latter chamber the fluid passing through the radial slots 39 provided in the flange part 28 of the bush 27 fills the annular cavity formed between the bush itself and the bore of the slide valve in which the bush is fitted, so as to act on the end surface of said bore, thus exerting on the slide valve itself an axial force which is sufficiently high to overcome the resilient force exerted by the spring 25; the result of this is that the slide valve is shifted to the left in FIG. 1, as illustrated in FIG. 2, thus bringing about the separation of the second bush 33 from the corresponding support surface 37; this displacement is possible because in the other end chamber 40 atmospheric pressure still prevails, the valve part 52 being in the original rest position, i.e. in which it communicates the aforesaid chamber with the outlet.

In the arrangement thus brought about the slide valve 16 communicates, as clearly evident in FIG. 2, the central chamber 10 with its adjacent chamber 12, with the result that fluid under pressure is supplied to the interior of this latter chamber and thus through the tube 20 (FIG. 4) into the upper chamber 12' of the cylinder 2. In the same arrangement, the slide valve 16 also opens the communication between the chambers 11 and 13, with the result that the lower chamber 11' of the aforementioned cylinder is communicated firstly with the chamber 11 and then through this latter with the chamber 13 and thus with the outlet.

Therefore, in this arrangement the downward stroke of the piston 4 is actuated.

During this downward stroke the distributor of the invention is able to ensure that this takes place in a regular manner, i.e. at a predetermined velocity proportional to the rate of flow of fluid fed into the upper chamber 12' of the cylinder 2, and to take action to reduce this velocity whenever it exceeds the predetermined value. The aforementioned intervention takes place in the following manner: whenever the downward stroke of the piston 4 occurs at a velocity higher than that desired an underpressure tends to be formed inside the upper chamber 12', since the volume left free at any moment by the displacement of said piston is greater than that which is supplied by the flow entering the chamber itself through the tube 20; the aforementioned underpressure is transmitted through said tube into chamber 12 of the distributor and from this through the portion of bore 15 connecting this chamber with the central chamber 10 is transmitted to this latter, thus altering the value of the pressure in the duct 17, which decreases in relation to the original value; the result of this is that the pressure thus reduced and transmitted from the duct 17 passes through to the bore 45*e* upstream of the valve 50 which opens under the action of the pressure difference applied thereto (in the bore 45*a* there is the original pressure, whereas in the bore 45*e* there is the reduced pressure), thus allowing the pressure prevailing inside the chamber 30 also to be reduced (and thus on the end surface of the bore of the slide valve 16 in which the bush 27 is accommodated). Therefore, a reduction occurs in the force which tends to displace the slide valve leftwards, in which case the slide valve is caused to be displaced slightly to the right under the influence of the spring 25 into a new position in which the conical surface 59 (FIGS. 2, 5 and 6), which adjoins the control surface 57 of the slide valve 16, throttles to a greater extent the passage width between the chambers 11 and 13; in fact, it is evident that between the aforementioned chambers there is an annular passage width whose useful cross-section is substantially that lying between the two circumferences obtained at the intersections of the surface of the bore 15 (FIGS. 5 and 6) and of the conical surface 59 with the plane P—P which includes the edge of the portion of bore 15 leading towards the chamber 11; the path of these two circumferences is indicated by $C_1$ and $C_2$ in FIGS. 5 and 6. Whereas the first circumference is of constant diameter (that of bore 15), the diameter of the second circumference depends on the axial position of the conical surface 59 (and thus of the slide valve 16) in relation to the body 19 of the distributor; in FIGS. 5 and 6 there are shown two different conditions, each of which corresponds to a different passage cross-section between the chambers 11 and 13. As a result of the throttling of the passage between these chambers thus obtained (corresponding for example to the transition from the condition in FIG. 5 to that in FIG. 6), a considerable increase occurs in the resistance to the passage of fluid between these chambers and, therefore, in the chamber 11 of the distributor and in the chamber 11' (FIG. 4) of the cylinder 2 there is created a back pressure of sufficiently high value to reduce the velocity of the downward stroke of the piston 4.

It is thus evident that the control described above, brought about by the distributor of the invention, is such that it ensures that the velocity of the piston 4 corresponds to the velocity attained when fluid is fed to the interior of the chamber 12', without creating any underpressure therein, and is thus the velocity which corresponds exactly to the rate of flow of fluid fed into said chamber.

When the electro-valve 47 returns to its de-energised position, in which the valve part 46 shuts off once more the supply of fluid to the chamber 30 and communicates this latter with the outlet, the slide valve 16 is returned to the original rest position in FIG. 1 under the influence of the helical spring 25 which, acting on the shoulder 34 of the bush 33, returns this latter against the support surface 37 of the block 32.

Figure 3:
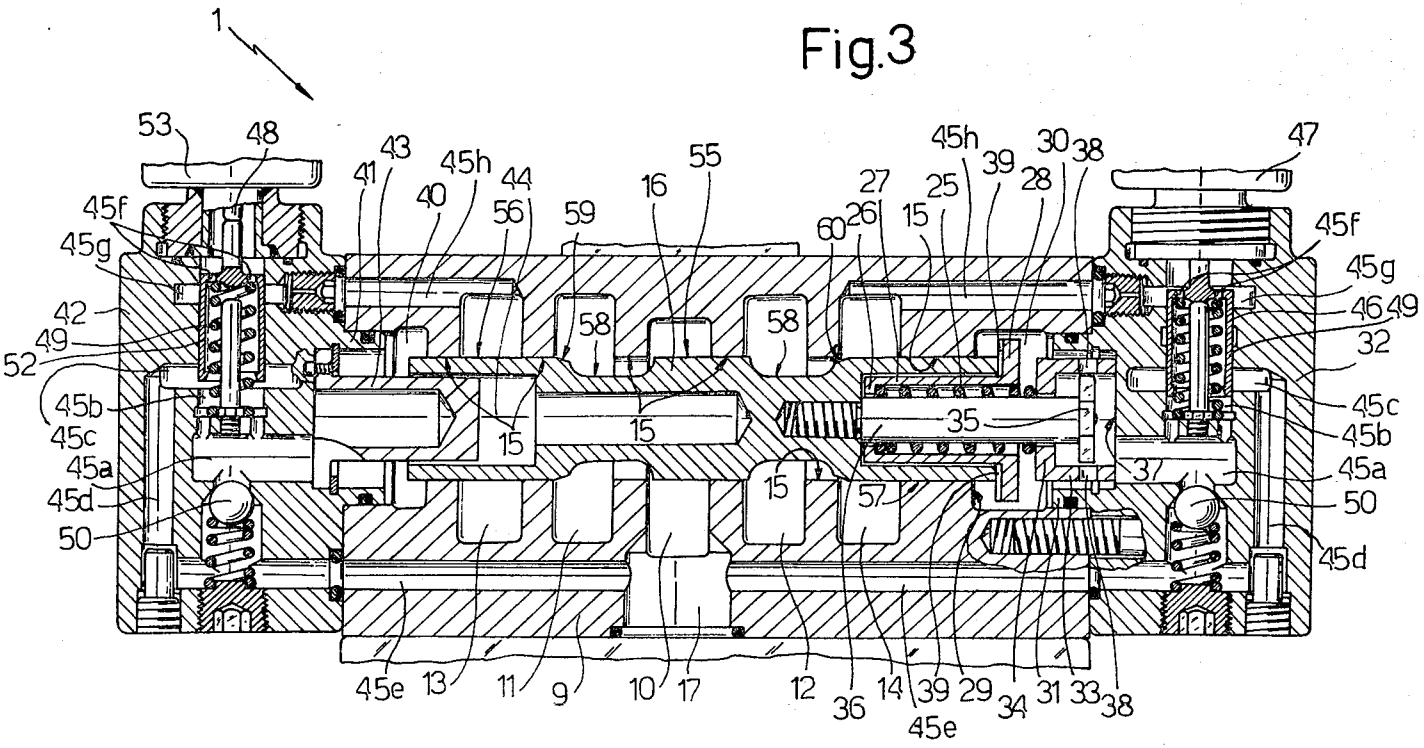
FIG. 3 illustrates a sectional view of the distributor, similar to that in FIG. 1 but in a second operative position.

If, however, it is desired to actuate the displacement of the piston 4 of the cylinder 2 upwards instead of downwards, it is merely necessary to energise the valve 53 instead of the valve 47, which has the effect of communicating the chamber 10 with the chamber 40 and of closing the communication between chamber 40 and the outlet; accordingly, in a manner entirely analogous to that described above there is brought about the displacement of the slide valve 16 to the right in FIG. 1, as shown in FIG. 3, with the result that the chamber 10 is communicated with the chamber 11 and thus fluid under pressure is fed to the interior of the chamber 11' (FIG. 4) and the chambers 12 and 13 are communicated, thus allowing the fluid to be released from the upper chamber 12' of the cylinder 2.

When the slide valve 16 is displaced to the right, it shifts in the same direction the first bush 27, compressing further the helical spring 25, whereas the head 35 of the screw 36 separates from the shoulder 34 of the second bush 33, as is shown in FIG. 3.

It is obvious that without departing from the scope of the invention it is possible for modifications and variations to be made to the described and illustrated embodiment of the present invention.

In particular, each control surface 56, 57, which in the described and illustrated embodiment comprise conical surfaces 59 and 60, could comprise differently shaped surfaces, provided that they are able to throttle the associated passage cross-sections which they control in substantially continuous manner, when a variation occurs in the axial position of the slide valve 16.

We claim:

1. A distributor for a hydraulic circuit, which is designed to control the supply of a fluid under pressure into a chamber of a hydraulic actuator and the outlet of the said fluid from another chamber of said actuator, said actuator having a movable member responsive to fluid pressure in the chambers of said actuator, said distributor comprising a first chamber and a second chamber designed to be selectively communicated with one of said chambers of the actuator, and a single slide valve movable within said first and second chambers in the direction of its axis in a corresponding seat of the distributor and designed to adopt a first position, in which it connects hydraulically said first chamber of the distributor to a source of fluid under pressure and, simultaneously, said second chamber of the distributor to a fluid outlet, and to adopt a second position, in which it connects hydraulically said second chamber of the distributor to said source of fluid and, simultaneously, said first chamber of the distributor to said fluid outlet, restoring means normally holding said slide valve in a rest position in which it prevents any communication between either of said two distributor chambers and between said fluid source and said fluid outlet, characterized in that said restoring means comprises means responsive to the pressure prevailing inside said first and second chambers of the distributor, means for choking the outlet cross-section for the fluid from said first and second chambers of the distributor, said pressure-responsive means being connected to said choking means so that, as a result of a reduction in the fluid pressure in said first or second chamber of the distributor, caused as a result of a displacement of the movable member of said actuator at a velocity higher than a predetermined velocity, said choking means brings about a decrease in said outlet cross-section from said second or first chamber of the distributor, respectively, so as to cause an increase in the pressure in one of said chambers of the actuator in order to reduce the velocity of said movable member, said slide valve having first and second active surfaces, the actuation of said slide valve from said rest position towards said first or second position being effected by causing said fluid to act, respectively, on the first or second active surface of the slide valve itself, whereas the outlet pressure acts, respectively, on said second or first active surface, said pressure-responsive means comprising a first duct and a second duct which communicate said first and second chamber of the distributor, respectively, with said first and second active surface, and which are designed to transmit at any moment the pressure prevailing in said first and second chamber, respectively, to said first and second active surfaces, in such a way as to cause the slide valve of said distributor to adopt at any moment a predetermined axial position depending on said pressure, and said means for choking the outlet cross-section comprising a first intermediate chamber disposed between said first chamber and said fluid outlet and a second intermediate chamber disposed between said second chamber and said fluid outlet, each of said first and second chambers being communicated, respectively, with said first and second intermediate chambers through a corresponding bore traversed by a portion of said slide valve, there being provided on each of said portions of the slide valve a first control surface shaped so as to vary continuously the passage cross-section formed between said portions and the corresponding bore, as a function of the axial displacement of the slide valve.

2. A distributor according to claim 1, characterized in that each of said first control surfaces comprises a conical surface and a cylindrical surface, these surfaces being adjacent and coaxial.

3. A distributor according to claim 1, characterized in that said first and second chambers are disposed laterally and on opposite sides with respect to a supply chamber connected hydraulically to a source of fluid under pressure and said first and second intermediate chambers are disposed laterally and on opposite sides with respect to said first and second chambers, said supply chamber being communicated with each of said first and second chambers by means of a bore traversed by a portion of said slide valve, a second control surface on the last named portion of said slide valve designed to close the communication from said supply chamber to said first and second chambers, when said slide valve is situated in said rest position, and to communicate said supply chamber with said first or second chamber, when said slide valve is situated in said first or second position.

4. A distributor according to claim 3, characterized in that said second control surface comprises a cylindrical surface.

5. A distributor according to claim 1, characterized in that each of said first and second active surfaces of the slide valve is communicated respectively with a first and second cavity into which discharge respectively said first and second ducts, each of said first and second ducts hydraulically connecting said supply chamber to said first and second cavities.

6. A distributor according to claim 5, including first and second passages designed to communicate respectively said first and second cavities with the outlet, valve means being provided along said first and second passages and said first and second ducts so as to enable each of said cavities to be communicated with said supply chamber or with the outlet.

7. A distributor according to claim 1, characterized in that said restoring means comprise a helical spring, one end of which bears against a shoulder of a first bush accommodated in one end of said slide valve and movable axially with respect thereto, and the other end of which bears against a shoulder of a second bush designed to be applied against the head of a screw which passes through said spring and is fixed to said slide valve, said bushes bearing against corresponding support surfaces of the distributor.

* * * * *